United States Patent [19]

Leibowitz

[11] Patent Number: 4,507,864

[45] Date of Patent: Apr. 2, 1985

[54] CUTTING SHEARS

[76] Inventor: Martin N. Leibowitz, 1155 Hillsboro Mile, Suite 602, Hillsboro Beach, Fla. 33062

[21] Appl. No.: 403,294

[22] Filed: Jul. 30, 1982

Related U.S. Application Data

[63] Continuation-in-part of Ser. No. 392,958, Jun. 28, 1982, abandoned.

[51] Int. Cl.[3] ..... B26B 13/06; B26B 17/02; B26B 13/20; B26B 13/12

[52] U.S. Cl. ..... 30/248; 30/239; 30/253; 30/257

[58] Field of Search ..... 30/120.4, 239, 248, 30/253, 357

[56] References Cited

U.S. PATENT DOCUMENTS

| | | | |
|---|---|---|---|
| 20,879 | 7/1858 | Heinisch | 30/239 |
| 26,955 | 1/1860 | Smith . | |
| 54,508 | 5/1866 | Crouch . | |
| 98,826 | 1/1870 | Wendt | 30/259 |
| 160,102 | 2/1875 | Johnson | 30/254 |
| 183,755 | 10/1876 | Eckles | 30/254 |
| 460,705 | 10/1891 | Hansen . | |
| 547,264 | 10/1895 | Jennings | 30/257 |
| 627,401 | 6/1899 | Edwards | 30/120.4 |
| 916,076 | 3/1909 | Westerdahl | 30/257 |
| 975,059 | 11/1910 | Meissner . | |
| 985,048 | 2/1911 | Meissner . | |
| 2,505,705 | 4/1950 | Cohn | 30/253 |
| 2,512,862 | 6/1950 | Ingwer | 30/253 |
| 2,563,461 | 8/1951 | Franko | 30/257 |
| 2,712,179 | 7/1955 | Henry . | |
| 2,760,264 | 8/1956 | Javits | 30/257 |
| 2,769,237 | 11/1956 | Oxhandler | 30/257 |
| 2,897,591 | 8/1959 | Mastasi et al. | 30/253 |
| 3,078,503 | 2/1963 | Webb | 30/254 |
| 3,596,355 | 8/1971 | Wertepay, Sr. | 30/254 |

FOREIGN PATENT DOCUMENTS

| | | | |
|---|---|---|---|
| 192051 | 11/1907 | Fed. Rep. of Germany . | |
| 822506 | 11/1951 | Fed. Rep. of Germany . | |
| 2656754 | 6/1978 | Fed. Rep. of Germany | 30/257 |
| 557865 | 2/1957 | Italy . | |
| 795 | of 1866 | United Kingdom | 30/253 |
| 588530 | 5/1947 | United Kingdom | 30/248 |

*Primary Examiner*—Paul A. Bell
*Assistant Examiner*—Paul M. Heyrana, Sr.
*Attorney, Agent, or Firm*—Hubbard, Thurman, Turner & Tucker

[57] ABSTRACT

Cutting shears or scissors have pivotally connected blades and shank portions extending at an acute angle with respect to the cutting edges of the blades wherein handles of the shears connected to the shank portions lie forward of the pivot connection between the blades in the direction of cut of material to be cut by the shears. The shears handles are configured such that the handle to be grasped by the fingers of the operator's hand is fixed to a blade which has a surface adapted for supporting the shears during use thereof. The other blade is provided with a handle particularly adapted for receiving the thumb wherein rotation of the thumb together with thrust of the forearm in the direction of cut or closing action yields a large mechanical advantage without substantial manual effort. Handle configurations include a generally symmetrical handle having a transverse stirrup for engagement with the thumb and a contoured closed loop type thumb handle which is adapted to engage a large area of the thumb including the joint between the metacarpal and phalange bones.

6 Claims, 16 Drawing Figures

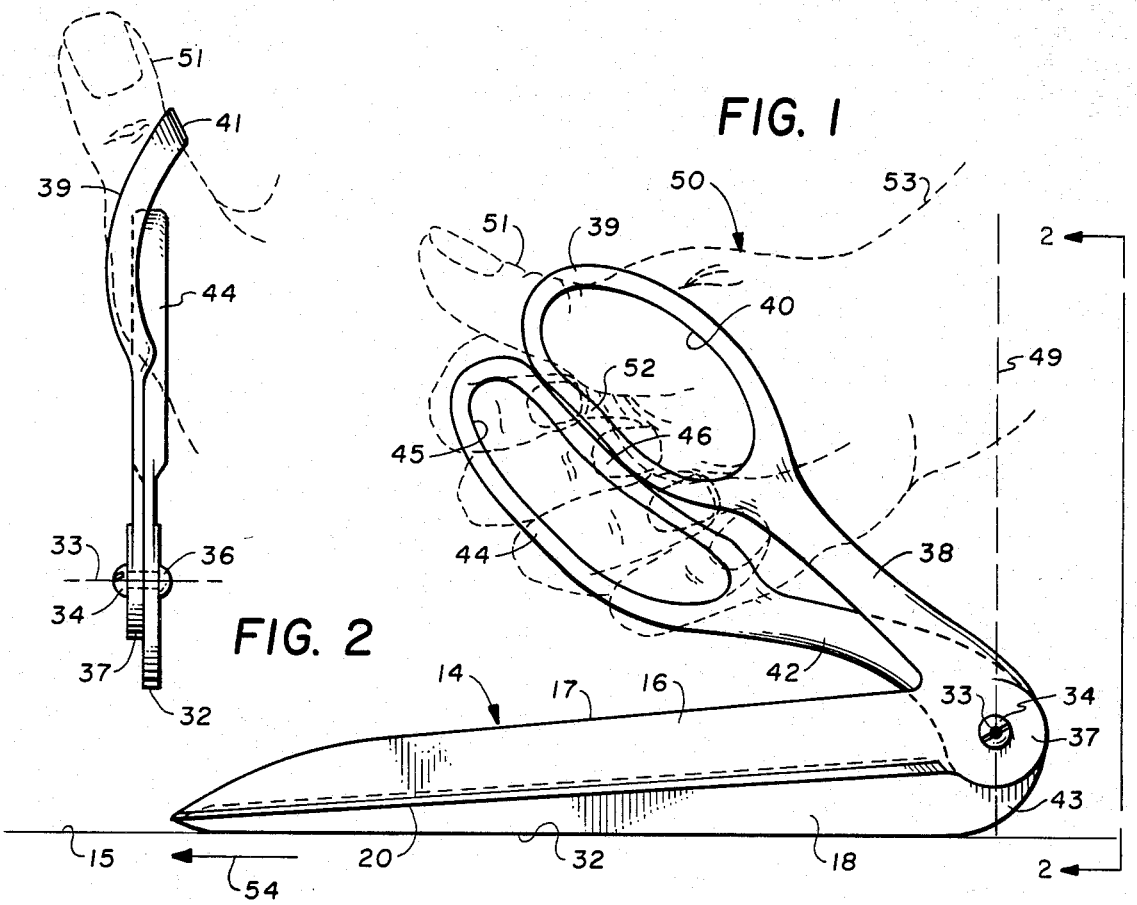
FIG. 1
FIG. 2
51
41
39
44
33
36
34
37
32
50
53
40
52
46
45
49
38
42
14
17
16
43
15
20
54
18
2
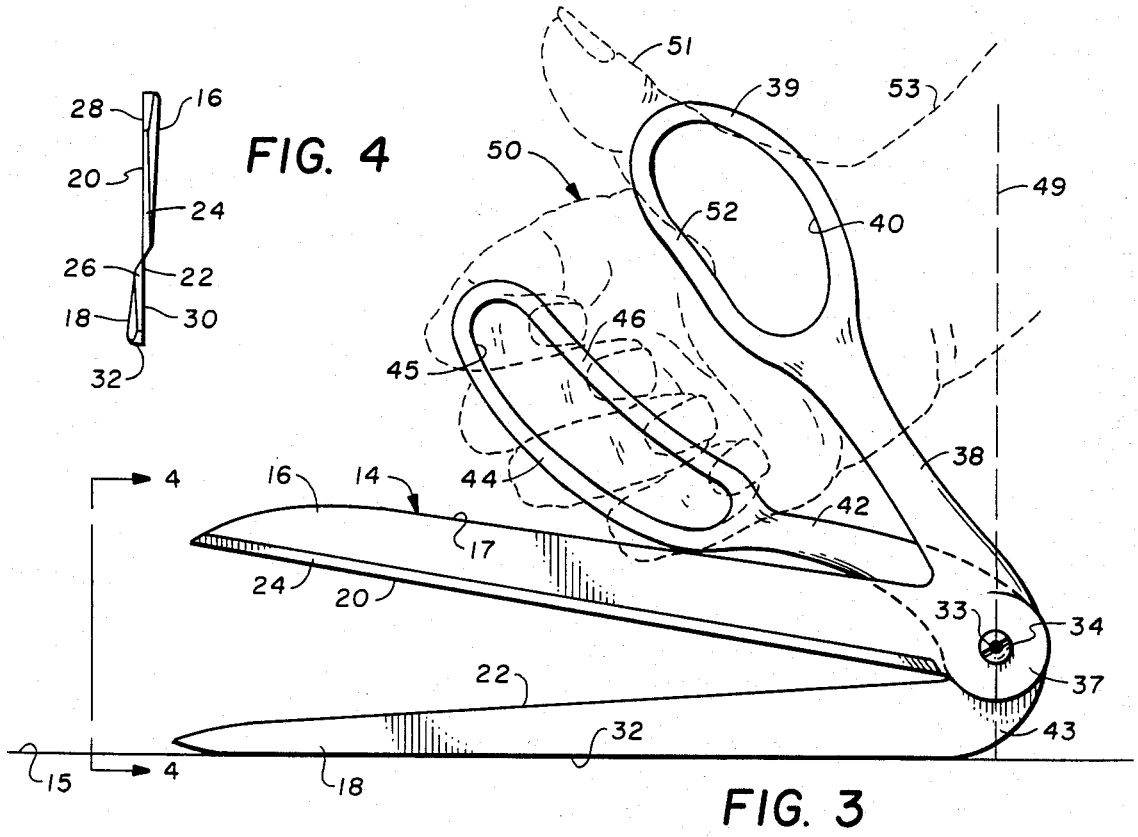
FIG. 4
FIG. 3
28
16
20
24
26
22
18
30
32
51
39
53
50
52
40
49
46
45
38
4
16
14
44
42
17
24
20
33
34
22
37
32
43
15
18

CUTTING SHEARS

CROSS-REFERENCE TO RELATED APPLICATION

This application is a continuation-in-part of prior co-pending application Ser. No. 392,958, filed June 28, 1982.

BACKGROUND OF THE INVENTION

1. Field of the Invention

The present invention pertains to tools including cutting shears having two pivotally connected blades which are each connected to respective handle portions arranged such that in the closing direction of the blades, the handles extend forward of a line passing through the pivot axis of the shears and genrally perpendicular to the direction of cutting.

2. Background of Art

In the art of manual cutting tools such as shears, scissors and other cutters, a great variety of designs have been developed for various purposes, including shears designed to cut relatively heavy fabric and shears for cutting thick sheet material such as sheet metal, linoleum and other relatively stiff materials. Although several relatively complex mechanisms have been developed to improve the mechanical advantage of shears and scissors, the classic design has prevailed which is characterized by a pair of blades pivotally secured to each other by a pivot pin wherein the blade shank and handle portion extend in a direction opposite to the blades themselves.

Several longstanding problems are associated with the use of conventional shears and scissors, particularly in relation to the cutting of relatively large pieces of heavy material such as fabrics, metal sheet, linoleum, carpeting, and similar materials. The configuration of conventional shears and similar scissor type cutting tools does not take advantage of the forces normally exerted on the shears in moving the blades in the direction of cutting. Moreover, the arrangement of the handle portions of conventional shears and scissors causes interference between the hand of the user and the separated pieces of cut material that extend along each side of the shears as they progress through the material being cut. The operating problems associated with the configuration of prior art cutting shears and related tools have persisted until the discovery of the invention described herein.

SUMMARY OF THE INVENTION

The present invention provides improved manually actuated tools including cutting shears or scissors of a type which are particularly adapted for cutting large sheet material of various thicknesses including material lying on a horizontal or inclined surface on which one blade of the shears may be supported during the cutting action. The cutting shears in accordance with the present invention may, of course, also be used for any operation to which conventional cutting shears are applied.

In accordance with one aspect of the present invention, there is provided a pair of cutting shears having pivotally connected blades which are movable between open and closed positions and which are provided with shank portions having handles which are disposed substantially forward of the pivot axis of the blades in the direction of advancement of the shears with respect to the material being cut. The handles and the cutting blades may lie substantially within a quadrant defined by a line parallel to the cutting direction and by a line perpendicular to the cutting direction and passing through the pivot axis of the blades. This configuration takes advantage of the forces exerted in moving the shears through the material being cut while resulting in less exertion of the hand in the operation of the shears, or alternatively, providing a greater mechanical cutting force for a given force exerted by the operator.

Further in accordance with the present invention, the configuration of the shears handles places the operator's hand well above or away from the material being cut during the movement of the shears through the material so that interference of the material with the operator's hand is avoided. This feature is particularly advantageous for cutting material which might inflict cuts on the operator's hand and enhances the cutting action by leaving the material to be cut relatively undisturbed or undeflected as the shears progress through the cut. Moreover, the cutting of material along a curved line is also easier as the shears handles and blade shanks are not in a position to interfere with the material already cut.

In accordance with another aspect of the present invention, there is provided cutting shears having handle configurations which take advantage of leverage which may be exerted by the operator's thumb without unduly stressing the thumb muscles. One handle configuration for cutting shears according to the present invention provides a support which includes greater supporting area for the thumb. Another inventive handle configuration provides for operation of the improved tools with either the right or left hand with substantially equal ease and comfort.

Although certain embodiments of the cutting shears described in the detailed description which follows herein are particularly adapted for cutting relatively large pieces of material lying on a supporting surface, the greater cutting force which may be exerted by the handle configuration of the shears is particularly advantageous for cutting any material considered relatively difficult to cut.

In accordance with a further aspect of the present invention there is provided a cutting tool particularly adapted for use as a toe and fingernail cutter which is adapted for both left and right handed operation. The improved nail cutter of the present invention utilizes an arrangement of handle portions on opposed pivotally connected blades whereby the leverage exerted by the thumb is easily controlled to make a progressive cut of a fingernail or the like. The blades are configured to conform to a predetermined natural curvature of a toenail or fingernail and one of the blades includes a support for resting the nail cutter on a supporting surface to enhance the stability of the cutter. The cutter also includes a handle portion integral with the blade itself. Moreover, the opposed blade handle is configured to receive either the left or right thumb whereby use of the cutter with either hand is obtained with equal control.

In accordance with a still further aspect of the present invention, there is provided a tool for applying a substantial gripping or clamping force such as a nutcracker or the like having a handle configuration which provides for applying a substantial closing force on the tool and wherein the tool may be rested on a supporting surface in the application of the closing force. The handle configuration of the tool may provide an improved supporting portion for the thumb of the operator of the tool and an easily releasable handle portion for gripping by the fingers of the hand used to operate the tool.

Those skilled in the art will recognize the superior features and advantages of the tools of the present invention upon reading the detailed description which follows in conjunction with the drawings.

BRIEF DESCRIPTION OF THE DRAWINGS

FIG. 1 is a side elevation of a pair of improved cutting shears in accordance with the present invention and shown in the closed position;

FIG. 2 is an end view of the shears taken from the line 2—2 of FIG. 1 illustrating the configuration of the thumb handle;

FIG. 3 is a side elevation of the shears illustrated in FIG. 1 and shown in the open position;

FIG. 4 is an end view of the blades of the shears shown in FIGS. 1 through 3;

DESCRIPTION OF THE PREFERRED EMBODIMENTS

Figure 6:
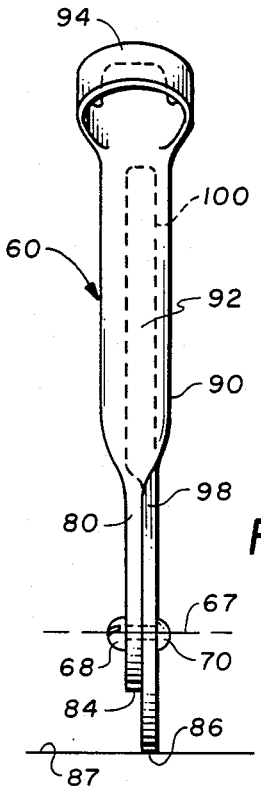
FIG. 6 is an end view of the cutting shears illustrated in FIG. 5 taken from the line 6—6 of FIG. 5.
Figure 5:
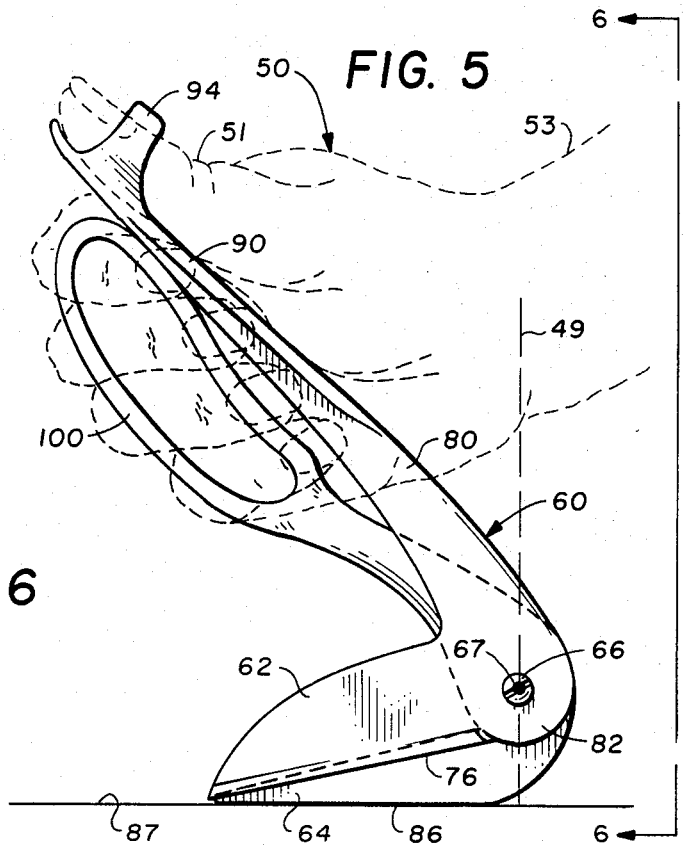
FIG. 5 is a side elevation of an alternate embodiment of a pair of cutting shears in accordance with the present invention and shown in the closed position.
Figure 7:
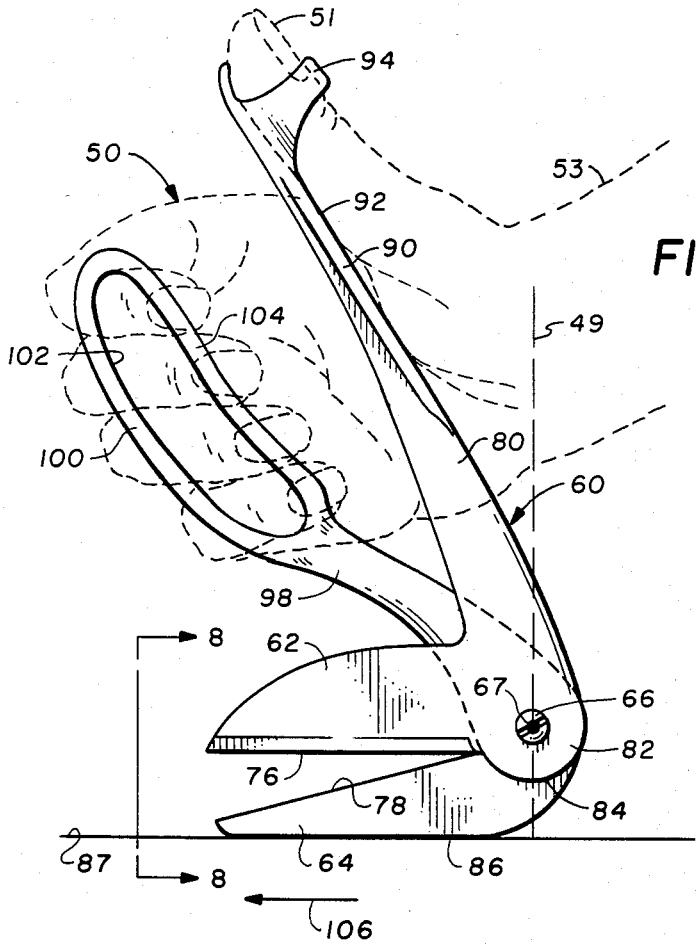
FIG. 7 is a side elevation view of the embodiment shown in FIG. 5 and illustrated in the open position.
Figure 8:
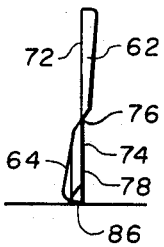
FIG. 8 is an end view of the blades of the cutting shears shown in FIGS. 5 through 7.
Figure 10:
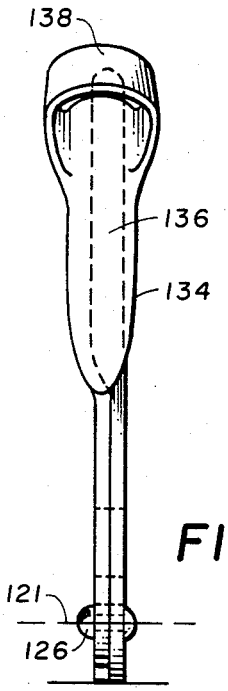
FIG. 10 is an end view taken from the line 10—10 of FIG. 9.

Referring to FIGS. 1 through 4, in particular, the present invention is characterized by a pair of cutting shears generally designated by the numeral 14 and shown in FIGS. 1 and 3 in the closed and open position, respectively. The cutting shears 14 are formed to have a pair of pivotally connected blades 16 and 18 each of which is provided with an elongated cutting edge 20 and 22, respectively. As shown in FIGS. 3 and 4, the cutting edges 20 and 22 are formed by the intersection of respective beveled surfaces 24 and 26 with corresponding adjacent flat sides 28 and 30 of the respective blades 16 and 18. The blade 18 is also provided with a generally flat longitudinally extending support surface 32 along the bottom side of the blade. The blades 16 and 18 are adapted to be secured together by a suitable pivot pin comprising a threaded screw 34 and a mating nut member 36. The blade 16 and 18 thus are operable to pivot with respect to each other about a pivot axis 33 formed by the pin 34. Alternatively, the pivot pin could be formed by upsetting a rivet or the like in place of the combination of the screw and nut 34 and 36. The blades 16 and 18 are secured together with the sides 28 and 30 adjacent to each other so that as the blades move between an open and closed position, the cutting edges 20 and 22 are operable to cut material interposed between the blades. As will be noted viewing FIGS. 1 through 3, the lower edge of a hub 37 of blade 16 is disposed above the lower longitudinal surface 32 of the blade 18 to provide clearance for material being cut by the shears 14 as the blades are moved through the cut material.

The blade 16 is provided with a shank portion 38 which extends from the hub 37 forwardly in the direction of the extension of the blade 16 and terminates in a handle portion 39 comprising a closed loop member having a generally oval shaped opening 40 formed therein. As will be noted viewing FIG. 2, the handle portion 39 is widened to have a thickness greater than the thickness of the blade 16 including the shank portion 38. Moreover, the handle portion 39 is formed to have a curvature extending out of the plane of the surface 28 so that the upper end 41 of the handle portion extends across the width of the handle portion of the blade 18.

As shown in FIGS. 1 and 2, the blade 18 also includes a shank portion 42 which extends forwardly from a hub portion 43 to overlie the blade 18. A closed loop handle portion 44 is also formed on the end of the shank portion 42 and is provided with an oval shaped opening 45 of a configuration to permit insertion of all of the fingers of the hand into the opening for gripping the handle portion 44 along one longitudinal side 46. The handle portion 44 is also formed to have a thickness somewhat greater than the shank portion 42 of the blade 18. Both the handle portions 39 and 44 may be integrally formed with the respective blades 16 and 18 or, the handle portions may be separately formed and attached to the shanks 38 and 42. The handle portions 39 and 44 might, for example, be made of a suitable plastic material molded onto the shank portions 38 and 42.

As will be appreciated from viewing FIGS. 1 and 2, the configuration of the handle portion 39 is such that it overlies and is engageable with the longitudinal side 46 of the handle portion 44 to delimit the pivotal movement of the blade 16 in moving to the closed position illustrated in FIG. 1. Moreover, the side 17 of the blade 16 opposite the cutting edge 20 is engageable with the handle portion 44, as illustrated in FIG. 3, to limit the pivotal movement of the blades 16 and 18 relative to each other in the opening position.

Those skilled in the art of cutting shears will readily appreciate from the foregoing description and from viewing drawing FIGS. 1 and 3, that the configuration of the handle portions 39 and 44 which are disposed forward of the pivot axis 33 in the direction of cutting action of the shears, provides a unique arrangement which is particularly advantageous for cutting large pieces of sheet material lying on a surface. The orientation of the handles 39 and 44 to lie substantially within a quadrant, one side of which is coextensive with the surface 32, and the other side being defined by a line 49 perpendicular to the surface 32 and passing through the pivot axis 33 formed by the pivot means 34–36, provides for an improved mechanical advantage of the cutting shears 14.

The drawing FIGS. 1 and 3 show the relationship of a human hand, generally designated by the numeral 50, with respect to the handle portions 39 and 44 in the use of the shears 14 in moving the blades between the closed and open positions, as illustrated in FIG. 1 and FIG. 3. In the use of the shears 14, all fingers of the hand 50 are placed in the opening 45 of the handle 44 and preferably grasp the longitudinal side 46 of the handle. The thumb 51 is placed through the opening 40 in the handle 39 and advantageously bears against a pad or surface portion of the handle, generally designated by the numeral 52 in the drawing figures. Moreover, the position of the handles 39 and 44 with respect to the pivot axis of the blades 16 and 18, also provides for increased leverage in that the thrust of the forearm 53 of the user may be applied directly against the handle 39 to enhance the closing action of the blades. This arrangement has been found to be much more restful in actuating the shears to open and close the blades 16 and 18 since the gripping or squeezing action of the hand is supplemented by the thrust of the forearm 53 using a portion of the person's weight as an actuating force for closing the blades, for example.

Since the closing action of the blade 16 is the result of application of force to the handle portion or pad 52, it is particularly advantageous to form the handle 39 to present maximum surface area for engagement by the thumb 51. FIG. 2 illustrates that the contour of the handle 39, including the pad 52, is such that it follows the outline of the side of the joint of the thumb between the metacarpal and phalange bones so that the padded portion of the hand in the vicinity of the joint may bear against the handle surface 52 to distribute the closing force exerted on the handle over a larger area than is provided by conventional shears handles. By arranging the handles 39 and 44 to lie within a quadrant bound on one side by the surface 32 and by a line perpendicular to the surface 32 and passing through the pivot axis of the shear blades, there is provided an improved shears configuration which requires substantially less actuating force to be applied by the muscles of the user's hand in the operation of squeezing the handles to close the cutting blades of the shears.

The shears 14 are particularly useful for cutting sheet material of all types and lying on a surface such as the surface 15, designated by the line indicated in FIGS. 1 and 3. By keeping the bottom surface 32 of the blade 18 in contact with the support surface 15, the blades of the shears 14 may be easily opened and closed as the shears are moved forward or generally in the direction of the arrow 54 in FIG. 1. Moreover, not only is an improved mechanical advantage given to the shears 14 in the normal use thereof, but the arrangement of the handles 39 and 44 takes advantage of the ability of the thumb of the human hand to pivot toward the fingers and generally at the joint of the thumb metacarpal and the wrist. As opposed to the prehensile movement of the hand in the operation of conventional cutting shears, the combined movement of rotation of the thumb toward the fingers, together with the thrust of the forearm, permits rotation of the blade 16 toward the closed position of the blades to exert a powerful cutting action, particularly when the surface 32 of the blade 18 is resting against a supporting surface. Accordingly, the cutting shears 14 may be advantageously used to cut relatively large sheets of material by moving the shears along a supporting surface such as the surface 15 and actuating the shears between the open and closed positions without moving the blade 18 away from the supporting surface. The configuration of the handle 44 is such that it is of sufficient width to engage the surface 17 of the blade 16 to limit the opening movement of the blades so that the handles 39 and 44 always lie within the quadrant delimited by the surface 32 and the line 49 passing through the pivot axis 33. Therefore, in the open position of the blades, the handles 39 and 44 do not move apart from each other beyond the normal open position of the hand as regards the movement of the thumb with respect to the fingers to a position which would be uncomfortable or would affect the mechanical advantage of the shear blades in moving between the open and closed positions.

Referring now to FIGS. 5 through 8, an alternate embodiment of a pair of cutting shears in accordance with the present invention is illustrated and generally designated by the numeral 60. The cutting shears 60 are particularly adapted for cutting relatively thick or hard material such as sheet metal or the like and comprise a pair of relatively short pivotally connected blades 62 and 64. The blades 62 and 64 are connected by suitable pivot means comprising a pin 66 extending through respective pivot holes in the blades 62 and 64 and including opposed head portions 68 and 70 for retaining the blades in assembly. The pivot pin 66 forms a pivot axis 67 and may be formed as a screw and nut assembly or as a member having upset ends to form the heads 68 and 70. The blades 62 and 64 have opposed flat surfaces 72 and 74 facing each other and elongated cooperable cutting edges 76 and 78, respectively, formed by the intersection of the surfaces 72 and 74 with suitable relief edges formed in a manner similar to the formation of the cutting edges for the blades of the shears 14.

The cutting blade 62 is preferably integrally formed with a shank portion 80 which extends at an acute angle with respect to the cutting edge 76 and a hub portion 82 delimited by a generally cylindrical outer surface 84. The surface 84 is adapted to be spaced from a generally flat bottom surface 86 of the blade 64 so that a substantial clearance is provided between a cutting support surface 87 and the blade 62 to facilitate cutting relatively inflexible material such as sheet metal or the like.

The shank 80 is adapted to support a handle portion 90 of the blade 76 which may be integrally formed with the shank 80 or may be a molded plastic member suitably secured to the shank 80. The handle 90 includes an elongated surface portion 92 and a transversely extending closed loop portion or stirrup 94. The surface 92 may desirably be molded to fit the contour of the bottom surface or palm side surface of the thumb of an average person to support the thumb in the manner illustrated in FIGS. 5 and 7. As will be appreciated viewing FIG. 6, the handle 90 is supported on the shank 80 to be generally symmetrical with respect to a plane passing through the center of the width of the blade 62 whereby the handle 90 is adapted for use with substantially equal comfort by either the left or the right hand, although for illustrative purposes, the shears 60 are shown being grasped by a right hand only in the drawing FIGS. 5 and 7. The blade 64 is also provided with an integral shank portion 98 extending at an acute angle with respect to the cutting surface 78 and including a handle 100 having an opening 102 formed by a closed loop. The handle 100 includes a longitudinally extending side portion 104 adapted to be gripped by the fingers of hand 50 and wherein the thumb 51 may be inserted in the stirrup 94 and rested against the surface 92 of the handle 90.

The cutting shears 60 also advantageously utilize the combined mechanical advantage of the rotation of the thumb 51 toward the fingers of the hand and the thrust of the forearm 53 which may be obtained by movement of the forearm with respect to the shoulder or by maintaining the arm rigid and utilizing any portion of the user's body weight to rotate the blade 62 with respect to the blade 64 to move the cutting edges 76 and 78 toward each other. The cutting shears 60 may be used in generally the same manner as described hereinabove for the cutting shears 14 by, for example, resting the blade 64 on the surface 87 and moving the shears 60 in the direction of the arrow 106 in FIG. 7 while rotating the blade 62 about the pivot axis 67. This rotation may be easily accomplished in the manner described above, particularly due to the fact that the handles 90 and 100 lie within a quadrant delimited by the support surface 87 and a line 49 perpendicular to that surface and passing through the pivot axis of the shears formed by the pin 66. Of course, the convenient cutting action provided by the shears 60 is enhanced by the generally symmetrical configuration of the handle 90 which may be used by either a right or left handed person with virtually equal comfort and performance. The general arrangement of the handles of the tools disclosed herein provides for application of the closing force exerted by the thumb in a direction which is substantially coincident with the plane in which the adjacent blade surfaces 72, 74 lie, for example. Accordingly, there is little or no tendency in the actuation of the cutting blades to cause the blades to spread apart thereby reducing the cutting action. This improved directional characteristic of the closing force on the thumb handle is provided by the configuration of the handle 90, in particular, regardless of which hand is used to actuate the shears.

Another alternate embodiment of the present invention is shown in FIGS. 9 through 12 of the drawings wherein there is illustrated a tool, generally designated by the numeral 120, comprising a pair of opposed pivotally connected working members 122 and 124. The members 122 and 124 comprise a pair of jaws pivotally connected to each other for relative movement about an axis 121 formed by a pivot pin member 126 which projects through respective hub portions 128 and 130 of the jaws. The tool 120 is characterized as a nutcracker and the opposed surfaces of the jaws 122 and 124 which face each other may be serrated as indicated by the numerals 123 and 125. The jaws 122 and 124 are also preferably reduced in thickness at the hub portions 128 and 130 so that in assembly, the jaws overlie each other and are of sufficient width to form a suitable clamping surface. The jaw 122 includes a shank portion 132 extending at an acute angle with respect to the general longitudinal extent of the jaw and including a handle portion 134 similar to the handle 90 for the cutting shears 60. The handle 134, in fact, includes a contoured surface 136 adapted to be engaged by the thumb 51 of the hand 50, as illustrated. The handle 134 also includes a transversely extending loop portion or stirrup 138 to assist in maintaining the thumb 51 in engagement with the handle portion during use of the tool.

The jaw 124 also includes an integral shank portion 140 extending upward and curving over the jaws 122 and 124 as illustrated in the drawing figures. The shank 140 includes a handle 142 formed thereon and having a slightly curved distal end 143. The handle 142 is slightly bifurcated and includes a stub tine portion 144 engageable with the little finger of the hand 50 to prevent slippage of the fingers downward onto the shank 140. Accordingly, the handle 142 has been formed to eliminate the closed loop but the tine 144 is of sufficient length to engage at least one finger of the hand to assist in moving the jaws between the open and closed positions. The jaw 124 is also formed with a support surface defined by two spaced apart feet 147 and 148 which provide for supporting the tool 120 on a suitable support surface 149.

Figure 9:
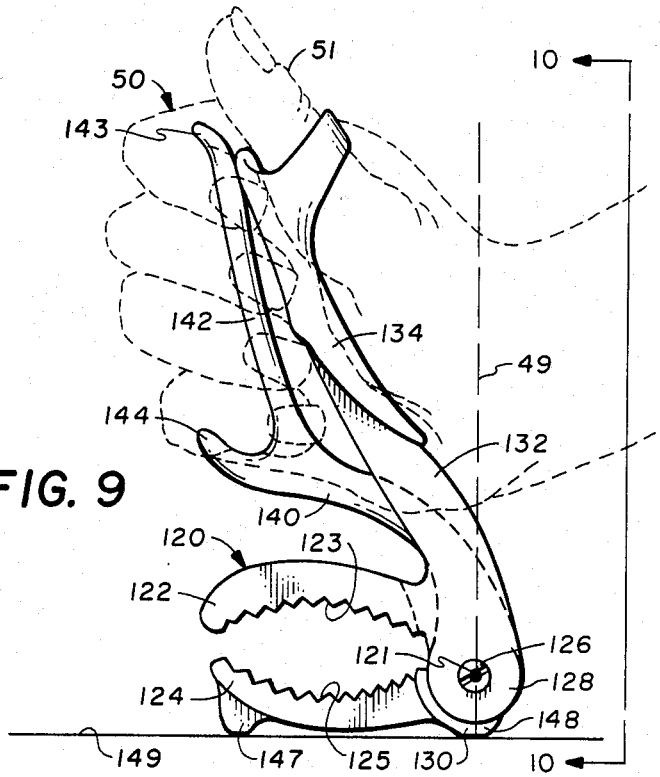
FIG. 9 is a side elevation of a clamping tool such as nutcracker embodying the handle configuration of the present invention.
Figure 11:
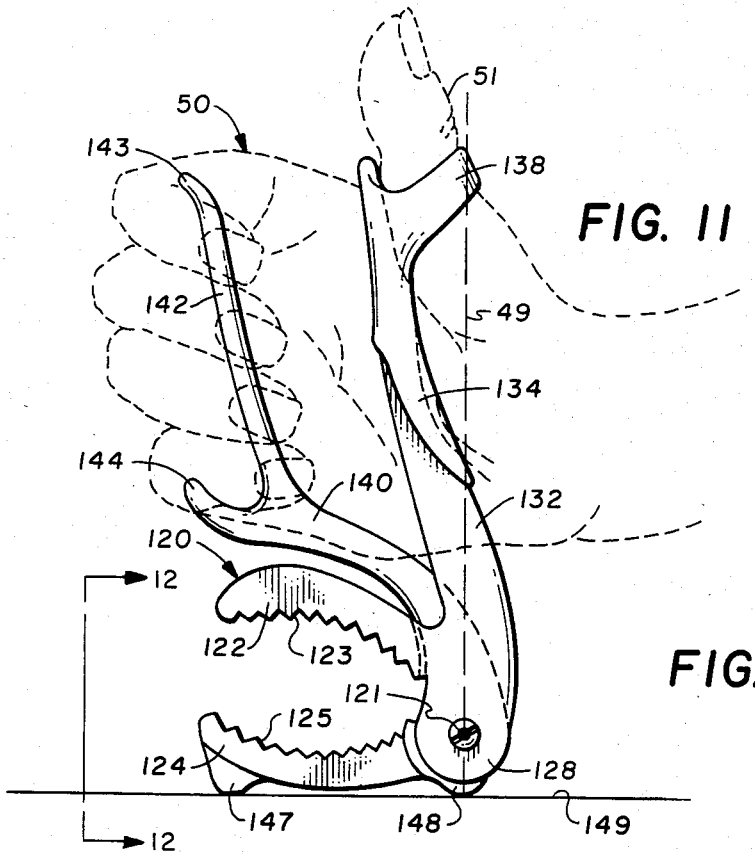
FIG. 11 is a view of the nutcracker tool in the open position.
Figure 12:
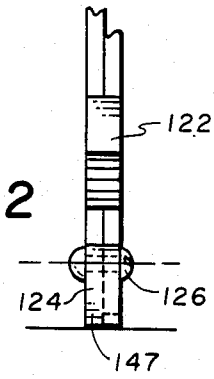
FIG. 12 is an end view taken from the line 12—12 of FIG. 11.

As will be appreciated from the foregoing description and from viewing the drawings FIGS. 9 and 11, the jaws of the tool 120 and the handles 134 and 142 lie entirely within a quadrant delimited by a straight line coincident with the support surface 149 and by a line 49 perpendicular to the surface 149 and passing through the pivot axis 121. The handles 134 and 142 are maintained substantially within the aforedescribed quadrant in both the open and closed positions of the jaws 122 and 124. By placing the handles 134 and 142 above and forward of the pivot axis 121 in the direction of movement of the handle 134 in closing the jaws of the tool, a substantial mechanical advantage may be enjoyed by the user of the tool without the exertion of a great deal of prehensile force by the hand. In fact, the jaw 122 is easily rotated from the opened to the closed position by rotation of the thumb 51 and, if this force is insufficient to apply a cracking force to a nut shell or the like, the forward thrust of the forearm may be transmitted through the thumb to the handle and shank of the jaw 122 to produce a substantial clamping action of the jaws. Accordingly, the same action of the user of the tool 122 as applied to the shears 14 and 60, may be used with greater mechanical advantage and with less physical exertion than prior art tools. Since the opening force of the jaws 122 and 124 is minimal as compared with the opening force sometimes required of cutting shears, the closed loop portion of the handle through which the fingers extend, may be eliminated and yet a comfortable handle member provided which does not require prehensile action to actuate the tool 120. Of course, the tool 120, as well as the shears 14 and 60, may be used in other positions without resting one of the jaws or blades on the support surface as preferred. Furthermore, even though the particular handle configurations for the tools 14, 60 and 120 are advantageously used with the respective tools shown, the handles for any one of the tools may be used on any of the other tools to provide the respective advantages of each handle configuration.

Another shears or cutting tool arrangement in accordance with the present invention is illustrated in FIGS. 13 through 16 of the drawings. Referring to these drawing figures, there is illustrated scissors for use in manicuring and the like and generally designated by the numeral 200. The scissors 200 include a pair of pivotally connected blades 202 and 204 which are pivotally connected for movement about an axis 205 formed by a suitable pivot pin 206 having opposed head portions 208 and 210. The blade 202 includes a recess 212 formed in one planar side thereof to receive a torsion coil spring 214 having opposed end portions 216 and 218. The spring end portions 216 and 218 are configured to terminate in oppositely projecting ends which fit in cooperating holes in the side faces of the blades 202 and 204, respectively. Accordingly, the spring 214 may be configured to provide a biasing force to urge the blades in either the open or closed position. In accordance with the present invention it is believed that it would be preferable to configure the spring to bias the blades toward the closed position shown in FIG. 14 so that the opposed cutting edges of the blades would not normally be exposed for accidental engagement and injury resulting therefrom.

Figure 13:
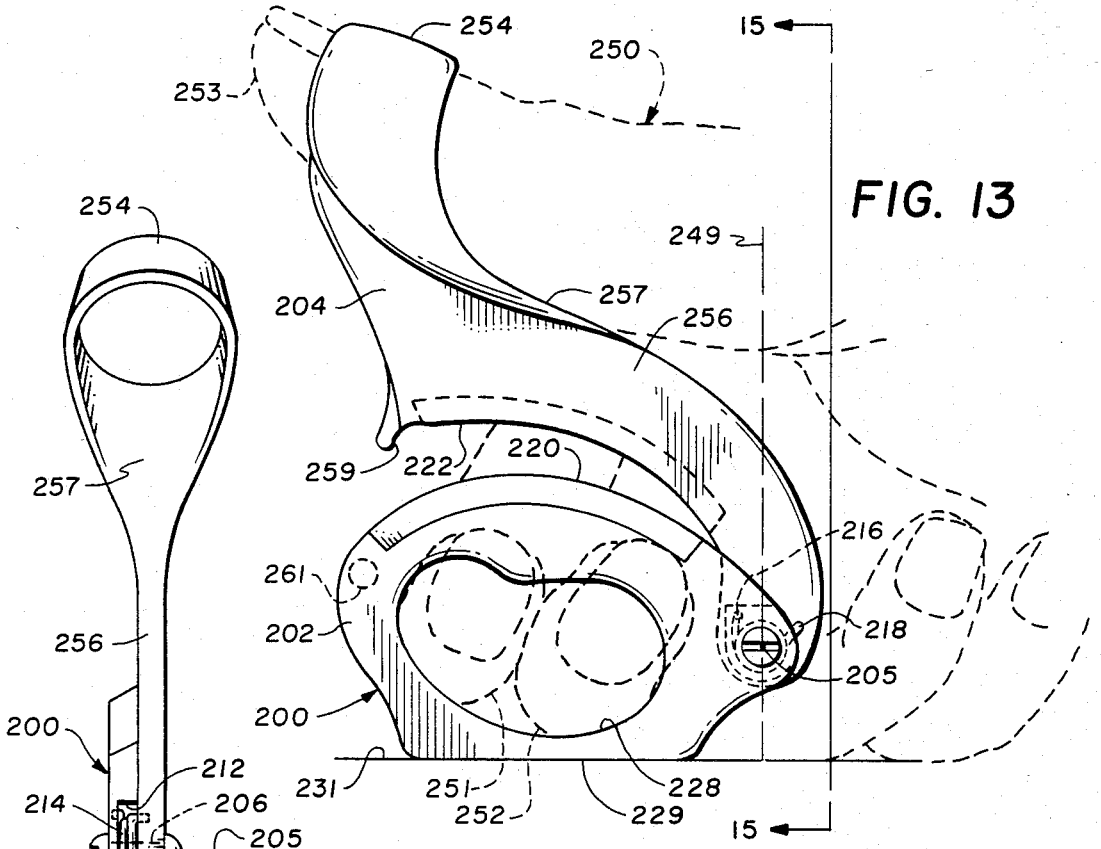
FIG. 13 is a side elevation of a cutting tool particularly adapted for use as a fingernail cutter.
Figure 15:
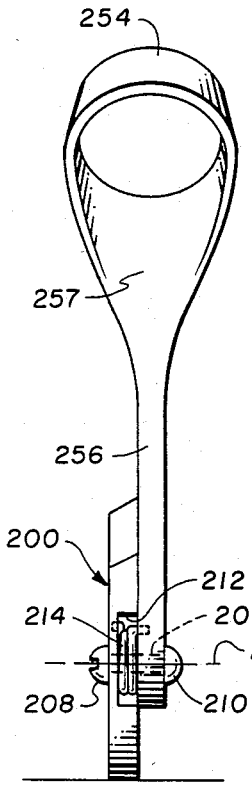
FIG. 15 is a view taken substantially along the line 15—15 of FIG. 14.
Figure 16:
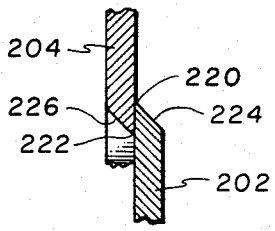
FIG. 16 is a view taken from the line 16—16 of FIG. 14.
Figure 14:
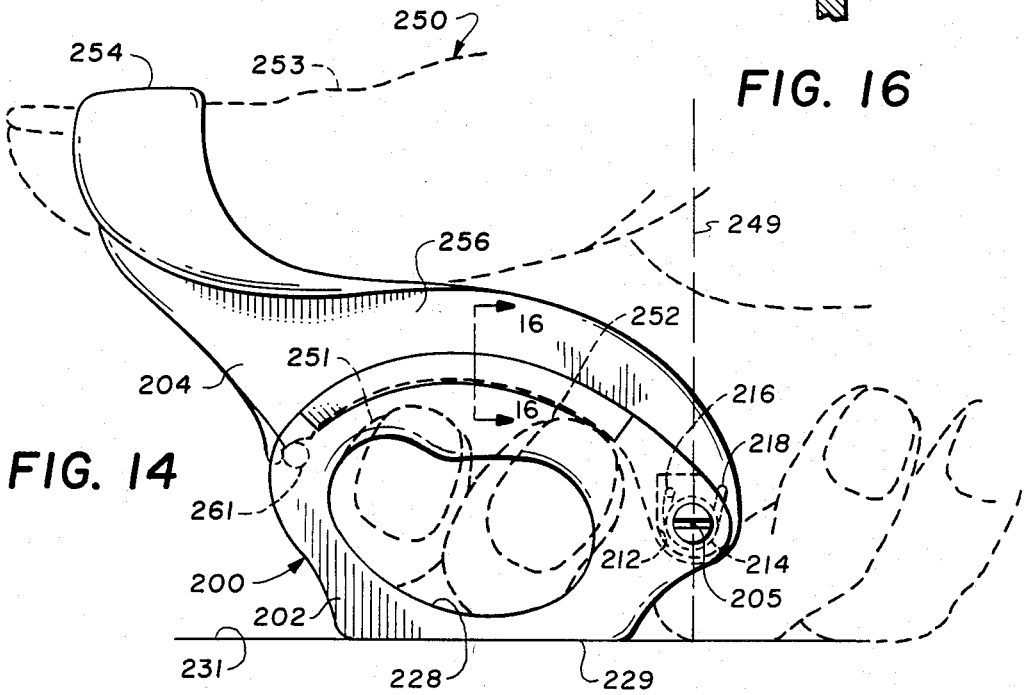
FIG. 14 is a side elevation of the fingernail cutter in the blade closed position.

Referring to FIGS. 13 and 16, in particular, the blades 202 and 204 are provided with generally arcuate cutting edges 220 and 222, respectively, which are formed by beveled surfaces 224 and 226. The curvature of the cutting edge 222 preferably has a radius greater than that of the cutting edge 220 and the location of the pivotal connection between the blades 202 and 204 is such that the cutting edges 220 and 222 provide a progressive cut from right to left, viewing FIGS. 13 and 14, as the blade 204 moves to the closed position. The cutting edges 220 and 222 may be formed integral with the blade structure or on separate inserts suitably secured to the blades.

The blade 202 is provided with a handle portion comprising a somewhat oval shaped cutout or recess 228 which is configured to receive the index and middle fingers 251 and 252, respectively, of a hand 250. The tips of the fingers 251 and 252 project through and grip the blade 202 and also serve as support means adjacent the cutting edge 220 as will be described further herein. The thumb 253 of the hand 250 is received in a stirrup 254 formed on a handle portion 256 of the blade 204. The handle portion 256 also includes a tapered support pad portion 257 formed integral with the stirrup 254 for resting the thumb thereon. The pad 257 and the stirrup 254 are arranged essentially symmetrical about the central plane of the blade 204, which plane is parallel to the plane of the cutting edge 222, so that the scissors 200 may be used with equal ease by the right or left hand and, considering the application of the scissors 200, may be used to cut the nail of one hand while being held in the other. The blade 202 also includes an integral support surface 229 which is adapted to support the blade 202 in use of the scissors whereby the handle 256 may be pivotally moved between open and closed positions while lying substantially in a quadrant delimited by a line 231 coincident with the surface 229 and a line 249 perpendicular to the line 231 and passing through the pivot axis formed by the pin 206. The blade 204 includes a stop surface 259 which is cooperable with a stop pin 261 projecting from the side of the blade 202 opposite that shown in the drawing figures.

The operation of the scissors 200 is believed to be readily apparent from the foregoing description. The scissors may be grasped by placing the thumb in the stirrup 254, as illustrated, with the index and middle fingers 251 and 252 placed through the opening formed by the recess 228 so that the opposed blades 202 and 204 are conveniently gripped for movement between open and closed positions. The arrangement of the recess 28 directly under the cutting edge 220 also provides for resting the digit for which a nail is being cut between and on the tips of the fingers 251 and 252 which serve as a support during the cutting and trimming process. Thanks to the curvature of the blade cutting edges 220 and 222 a progressive cutting action on fingernails or toenails is provided, which is highly preferred over the conventional opposed jaw type nail trimmers or clippers, so that the nails are not likely to break during the cutting action. The cutting edges 220 and 222 make a straight cut which is preferred for trimming toenails; however, the scissors may be manipulated to make curved cuts by making a succession of short cutting actions when contouring fingernails, for example.

The scissors 200 may be held and operated in the cutting action or may rested on a surface such as the surface 231 to steady the cutting blades and assist in the cutting action. The user might prefer to cup the fingers of the hand having the nails being cut so that the cut nails will fall into the palm of the hand of which the fingers are being cut during use thereof. Of course, the scissors 200 may be used to cut other articles although it is particularly adapted for cutting fingernails or toenails.

The shears and other tools disclosed herein may be made of conventional materials of the art. The blade cutting edges may be integrally formed on the blade body or formed on separate blade inserts. The handle portions may be integrally formed with the blade and shank portions or as separate molded parts.

Although several embodiments of the present invention have been described in detail herein, those skilled in the art of tools of the type disclosed and claimed will recognize that various substitutions and modifications can be made to the exact configurations described without departing from the scope and spirit of the invention as recited in the appended claims.

What I claim is:

1. Manicuring scissors and the like comprising a pair of pivotally connected blade members, each of said blade members including means forming a cutting edge cooperable with the cutting edge of the other blade member for cutting fingernails and the like, one of said blade members including means forming a flat support surface thereon for supporting said scissors on a surface, said blade members each including handle means adapted to be engaged by at least one finger and the thumb of a hand, respectively, said handle means of said one blade member comprising an opening formed in said one blade member for receiving at least the index and middle fingers of said hand, said handle means of the other blade member including a support pad portion and a stirrup for receiving the thumb of said hand and disposed directly above said one blade member for actuating said blade members between blade open and closed positions when said one blade member is supported by said support surface on a horizontal surface, said handle means being arranged such that at least in the closed position of said scissors wherein said cutting edges lie ajacent to each other said blade members and said handle means lie substantially in a quadrant in a place perpendicular to the pivot axis of said blade member, said quadrant being delimited by a first line coincident with said support surface and a second line perpendicular to said first line and passing through said pivot axis.

2. The scissors set forth in claim 1 wherein:

said cutting edges of said blade members are curved to correspond substantially to the curvature of said nails.

3. The scissors set forth in claim 1 or 2 wherein:

said cutting edges of said blade members are shaped each that when said blade members are moved toward each other to cut a nail, said cutting edges cooperate to perform a progressive cut along said cutting edges in a direction away from said pivot axis.

4. The scissors set forth in claim 1 wherein:

said pad portion extends in a plane generally parallel to the plane of the cutting edge of said other blade member, and said stirrup forms an opening generally transverse to said cutting edge of said other blade member.

5. The scissors set forth in claim 1 further including:

spring means connected to said blade members for biasing said blade members in the closed position.

6. The scissors set forth in claim 1 or 5 and further including:

cooperating stop means on respective ones of said blade members and operable to limit the closing action of said blade members.

* * * * *